US008091181B2

(12) United States Patent
Van Doorn

(10) Patent No.: US 8,091,181 B2
(45) Date of Patent: Jan. 10, 2012

(54) METHOD, APPARATUS AND SYSTEM FOR ADDING MOISTURE TO COTTON FIBERS DURING THE COTTON GINNING PROCESS

(75) Inventor: Donald Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 316 days.

(21) Appl. No.: 12/417,342

(22) Filed: Apr. 2, 2009

(65) Prior Publication Data

US 2009/0249582 A1 Oct. 8, 2009

Related U.S. Application Data

(60) Provisional application No. 61/041,706, filed on Apr. 2, 2008.

(51) Int. Cl.
*D01B 9/00* (2006.01)

(52) U.S. Cl. ..... 19/66 CC

(58) Field of Classification Search ..... 19/66 CC
See application file for complete search history.

(56) References Cited

U.S. PATENT DOCUMENTS

| | | | | |
|---|---|---|---|---|
| 4,667,373 | A * | 5/1987 | Roder | 19/66 R |
| 5,361,450 | A * | 11/1994 | Shofner et al. | 19/66 R |
| 5,381,587 | A * | 1/1995 | Vandergriff | 19/48 R |
| 6,088,881 | A * | 7/2000 | Van Doorn et al. | 19/202 |
| 6,237,195 | B1 * | 5/2001 | Shoemaker | 19/66 CC |
| 6,314,618 | B1 * | 11/2001 | Mehner et al. | 19/48 R |
| 6,698,066 | B2 * | 3/2004 | Latham | 19/66 CC |
| 2008/0005869 | A1 * | 1/2008 | Cory | 19/66 R |
| 2008/0073802 | A1 * | 3/2008 | Anderson et al. | 261/118 |

* cited by examiner

*Primary Examiner* — Shaun R Hurley
(74) *Attorney, Agent, or Firm* — Smith, Gambrell & Russell

(57) ABSTRACT

An apparatus for adding moisture to cotton in a cotton ginning process utilizes a quick response heater generate a heated air flow which is routed to a series of conduits passing through a reservoir of water to raise water to at or near boiling to generate vapor at atmospheric pressure which is entrained in a portion of the heated air flow which is directed to the battery condenser and/or gin stand.

24 Claims, 3 Drawing Sheets

METHOD, APPARATUS AND SYSTEM FOR ADDING MOISTURE TO COTTON FIBERS DURING THE COTTON GINNING PROCESS

RELATED APPLICATION

This application claims priority to U.S. provisional patent application No. 61/041,706, filed Apr. 2, 2008, which is incorporated herewith by reference.

BACKGROUND OF THE INVENTION

The present invention relates to the field of cotton processing and more particularly to the process of restoring moisture to cotton fibers.

During the processing of cotton at a gin, controlling cotton moisture is very important. High moisture in the seed cotton prior to separating the fibers from the seed makes the cotton very difficult to clean. Seed cotton driers are used to lower the fiber moisture often below 6% for optimum cleaning. While this very significantly aids the cleaning processes, the fibers are weakened at these low moisture levels. Although, moisture restoration systems operating just prior to ginning are sometimes used to reduce the fiber breakage during the aggressive saw ginning process, moisture addition systems are primarily used to restore moisture to the ginned lint at, or just following, the battery condenser and just prior to the baling press. The added moisture in the lint batt fed to the press reduces the forces of compression required to make the highly compacted fibers in the bale produced at the press. Also, the added moisture reduces the bulk of the cotton batt flowing into the press, increasing processing rates. Further, lint moisture content of 7½% is the industry approved top limit for moisture content in the bale. With the lint often approaching the battery condenser at less than 5%, the addition of 2% moisture (approximately 10 pounds per bale) becomes a significant monetary incentive.

For many years, there have been two methods for adding moisture to cotton fibers at the gin. One method is to spray atomized water on the cotton batt as it leaves the battery condenser. This method results in uneven application of the moisture that can result in areas of excessive moisture in the bale with resultant fiber quality deterioration. This method is under strong criticism. The current dominant method employs an air humidification device involving water spray nozzles discharged into a stream of heated air to increase the air moisture content. This moisturized air then is blown through the cotton fibers moving through the ginning process. The cotton fibers must be cooler than the humidified air to cause the air temperature to drop below the dew point thereby depositing moisture on the surfaces of the cotton fibers. This process is generally effective, but is subject to the variations in the ambient air. Both the ambient air temperature and relative humidity variations, from day to night and from hour to hour throughout the day, coupled with the changes in the temperature of the cotton batt make this process very difficult to control. Additionally, the cooling effect of the evaporation of the water spray into the heated air lowers the air temperature such that the temperature of the moisturized air is sometimes not sufficiently higher than the cotton fiber temperature to cause the air to give up the needed amount of moisture to the cotton. Therefore, the average moisture addition with this method is limited and results in bale moisture averages well under the 7½% moisture level authorized by the industry leaders. Additionally, the water spray nozzles used to add moisture to the heated air require considerable effort to maintain their atomizing efficiency.

SUMMARY OF THE PRESENT INVENTION

It is an object of the present invention to enable the introduction of moisture into cotton as it is being processed. My present invention employs an entirely different approach to the generation of the high humidity and high temperature vapor mixture needed to more effectively add moisture to the cotton fibers. Rather than applying high volumes of heated air blown through spray nozzles, my process simply boils water to produce steam vapor to which enough ambient or heated air is added to produce the required vapor conditions at vapor temperatures just above the dew point and at sufficient temperature gradients above the cotton temperature.

The production of the air-water vapor mixture is directly and quickly responsive to the output of an air heater that heats air moving counter flow to the water in the steam generator, thus to maintain the water at the hot air entry at the boiling point, where the water vapors are released to be mixed with controlled amounts of ambient or heated air. The production of the water vapor in my process is analogous to bringing a pan of water up to the boiling point on the kitchen stove and simply rotating the burner control to almost instantaneously change from a low boil to rapid boiling. My process further employs a mixing valve that adds controlled ambient or heated air to the water vapor assisted by sub-atmospheric pressure at the exit of the mixing valve, which may be produced by the sub-atmospheric pressure in the battery condenser when my process is used for adding moisture within the battery condenser. If my system is used with other means to expose the humidified air to the cotton fibers, sub-atmospheric pressure at the discharge of the mixing valve is also part of the system. My Method, Apparatus, and System employs several other features that will be described in the following Preferred Embodiment of my invention.

These and other objects and advantages of the invention will become apparent from the following detailed description of the preferred embodiment of the invention.

BRIEF DESCRIPTION OF THE DRAWINGS

An apparatus for adding moisture to cotton being processed is depicted in the accompanying drawings which form a portion of this disclosure and wherein.

DESCRIPTION OF THE PREFERRED EMBODIMENT

Figure 1:
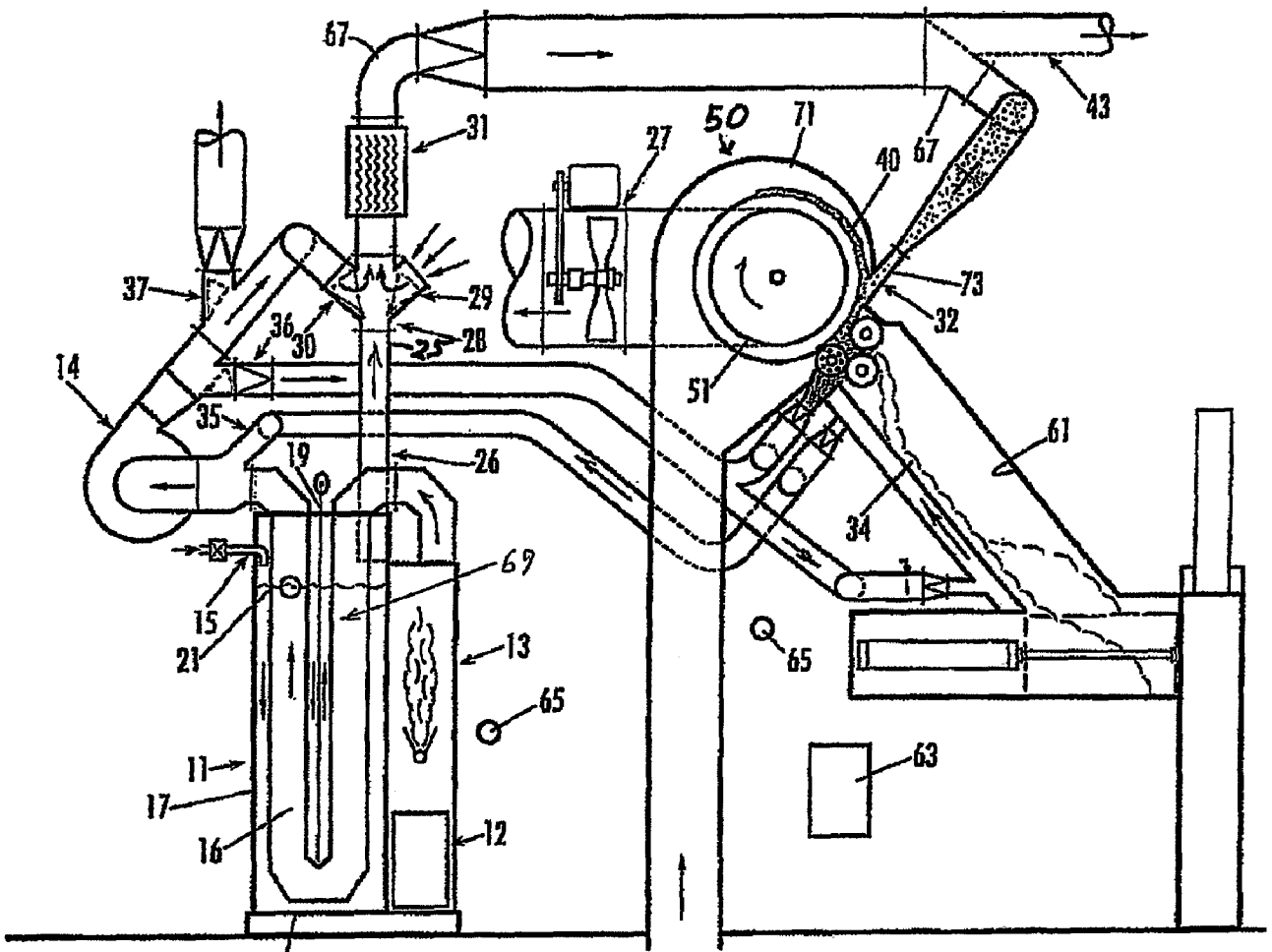
FIG. 1 is a diagrammatic elevational view of the moisture adding apparatus providing additional moisture to the baling system at the condenser.
Figure 2:
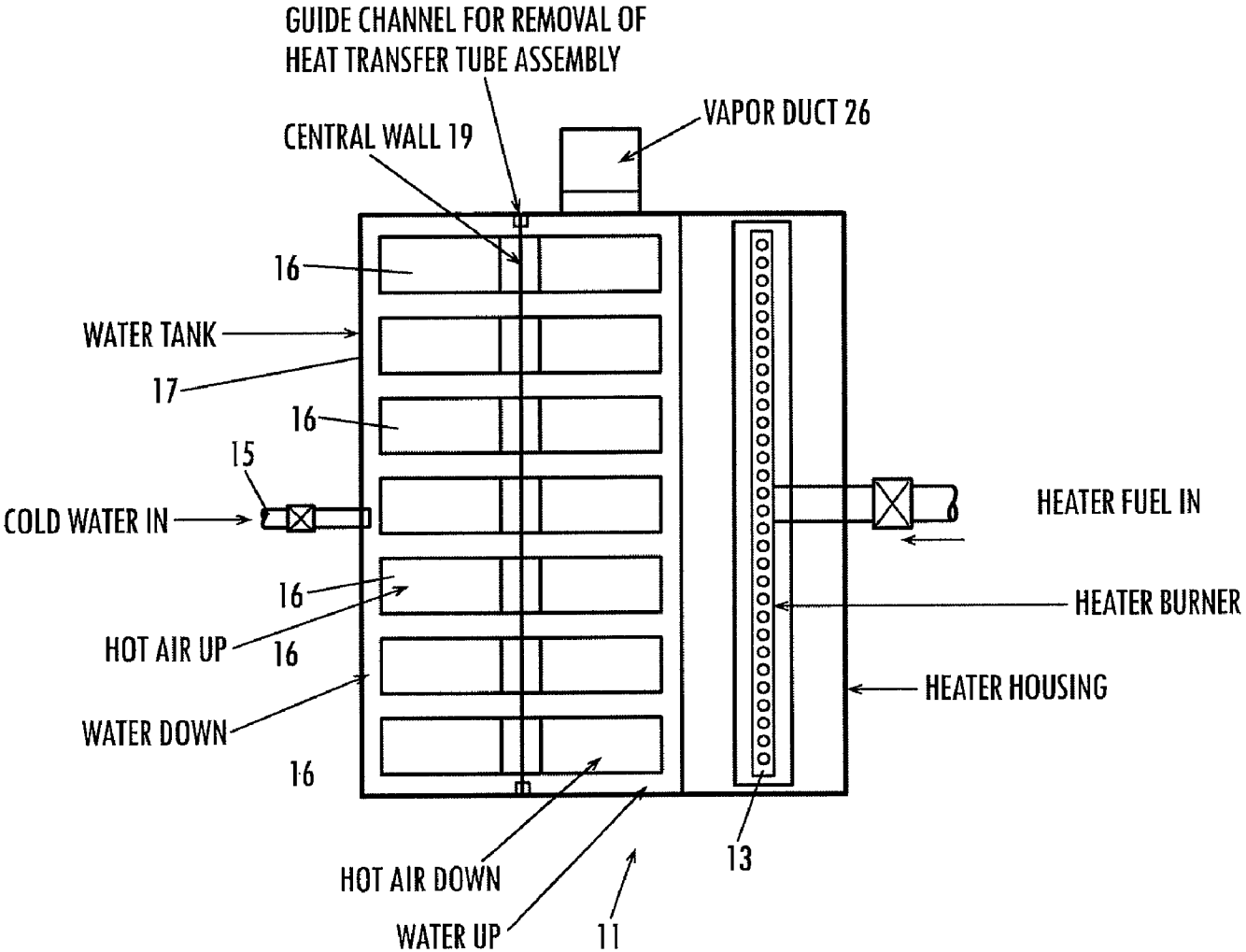
FIG. 2 is a plan sectional view of the steam generator just above the water line.
Figure 3:
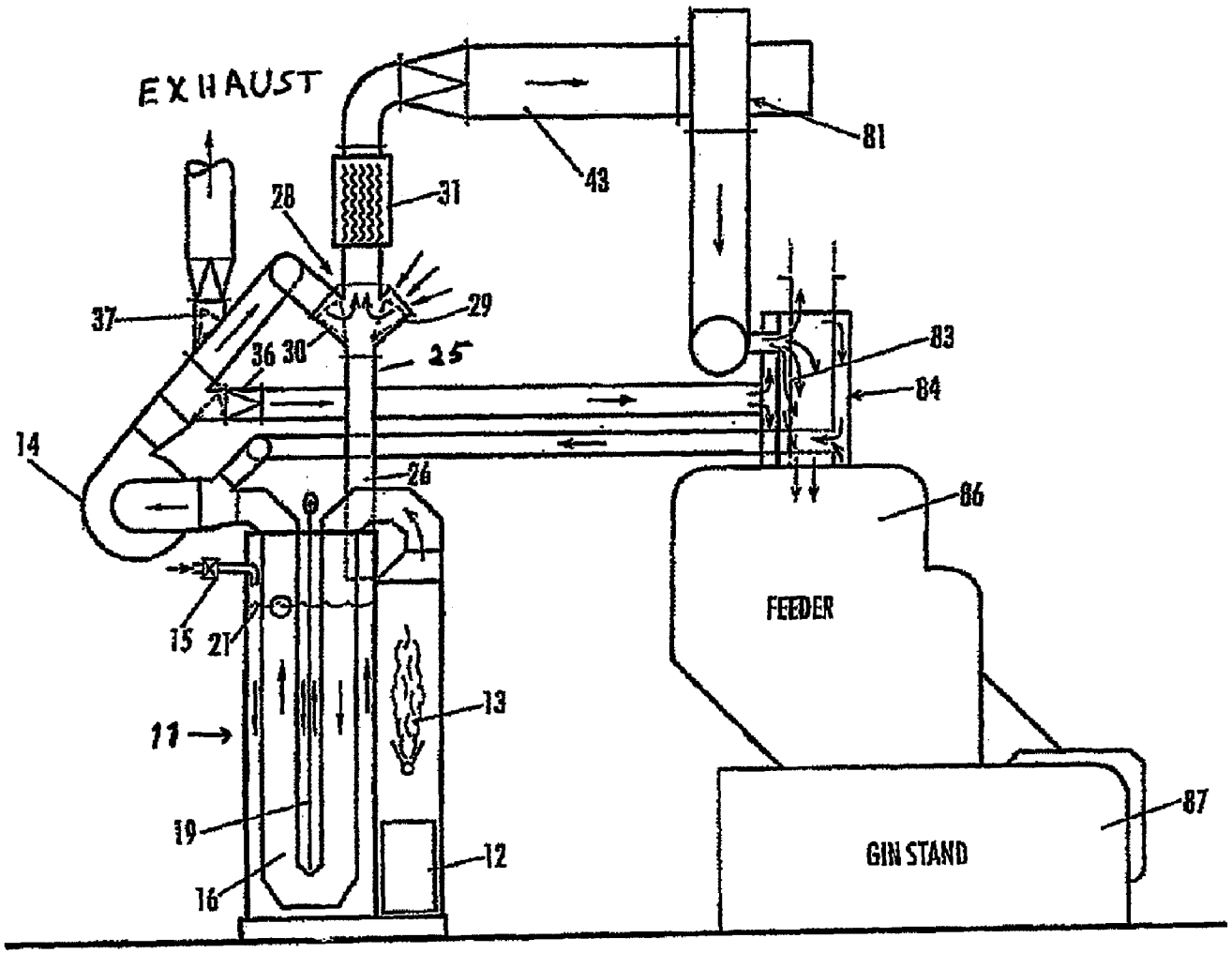
FIG. 3 is a diagrammatic elevational view of the moisture adding apparatus providing additional moisture at the gin stand.

Referring to FIGS. 1-3 for a clearer understanding of the invention, it may be seen that the preferred embodiment of the invention contemplates a moisturizing system for primarily adding moisture to the lint batt formed in the battery condenser feeding the cotton to the baling press of a cotton gin. This embodiment is shown diagrammatically in FIG. 1. The principal component of the system is the steam generator 11 shown at in FIG. 1 and in section in FIG. 3. Ambient air is drawn through screened inlet 12 then through air heater 13 by system fan 14. The quantity of the ambient air drawn in may be modulated by the use of sensors and control logic. The heated air is drawn upward from the heater by fan 14 such that the air stream is first divided into a series of side-by-side rectangular cross-section ducts 16 passing downward vertically through a water tank 17. The water tank 17 and heater 13 may share a common wall which facilitates heat transfer to the water, thus the rectangular ducts may be considered to be extensions of the heat transfer wall. Water tank 17 is divided by a central wall 19 extending from above the top of the water level 21 to just above the bottom 23 of the tank 17, thus water can only move from one side of the tank to the other by passing beneath central wall 19. Rectangular ducts 16 are surrounded vertically by water and pass beneath wall 19 and extend vertically upward to above the water level 21, where the several ducts converge into a single hot air duct into the inlet of fan 14. The several rectangular ducts and tank are sized to maximize the heat transfer surfaces while controlling the water volume to minimize the "heat sink" effect of the water for quick response to the heater modulations. It will be appreciated that the most rapid heat transfer to the water will occur in the water closest to the heater 13. Water that may be treated with softeners enters the tank at 15 in FIG. 1 in response to a water level indicator. Thus, the cold water enters the tank at the farthest point from the hot air entry, providing counter-flow to replace evaporated water near the heater, for the highest efficiency heat transfer from the heated rectangular ducts to the water. To aid in periodically removing scale from the outside of the rectangular ducts, the ducts and the central wall may be an assembly that may be lifted out of the tank as a unit.

As will be understood from the forgoing, the heat transfer to the water closest to the heat causes the water surface from which the water vapor emits to be adjacent the entry point of the hot air into the tank. Consequently, a vapor duct 26, connected to the tank wall above the water level 21 and between central wall 19 and heater 13, draws the vapor upward under the influence of the battery condenser dust flue fan 27. A short distance above the tank, vapor duct 26 becomes an inlet 25 which joins mixing valve 28. Mixing valve 28 has two additional inlets that are controlled manually or through the use of sensors, control algorithms, and valve actuators. Inlet 29 is the variable ambient air inlet. Inlet 30 is a controllable exhaust hot air inlet.

Because of the variability of the temperature of the hot air exhaust from fan 14, a separate small air heater may be used to obtain more precise temperature control. Important functions of the controllable inlets 29 and 30 will be discussed later in detail. The air-water vapor mixture moves vertically from the mixing valve 28 through a condensate eliminator 31 through ductwork over to the battery condenser inlet 32, where the mixture is drawn through the final batt 40 formed on the condenser drum 51 under the influence of the condenser dust flue suction fan 27. At this point, the air-water vapor mixture must be at a temperature gradient above the temperature of the cotton batt 40 on the condenser drum 51 and have a relative humidity such that a dew point will be reached when the vapor contacts cooler cotton batt 40, causing the condensation of moisture on the fibers in cotton batt 40. Sensors 71 and 73 monitor the temperature of the cotton fiber forming batt 40 and the temperature and relative humidity of the air flow at battery condenser inlet 32.

The transfer of moisture to cotton process is commonly misunderstood. Because cotton is highly hygroscopic, it is commonly thought that the cotton fibers immediately absorb the moisture condensate as the dew point of the air is reached. However, the moisture transfer process of this invention occurs in a split second. It is akin to blowing warm, moist breath against a cold window pane in which the moisture condensing out of the warm breath on the cold pane is adsorbed, not absorbed, as glass cannot absorb moisture. Once the minute water particles are adsorbed onto the surfaces of the cotton fibers almost instantaneously, the moisture will soon be absorbed by the highly hygroscopic cotton fibers.

FIG. 1 also shows an alternate duct 43 which may, in combination with the battery condenser moisture addition system or as a completely separate system, lead to moisture addition means for moisturizing the seed cotton just prior to the ginning process (See FIG. 3). My invention also includes the further efficient use of the exhaust air from the main steam generator unit 11. Already mentioned is the hot exhaust air inlet to the mixing valve 28. Hot exhaust air inlet 30 may be used to increase the temperature of the air-water vapor mixture to increase the temperature gradient between the cotton surface and the air-water vapor mixture to increase the intensity of the moisture adsorption on the fiber surfaces of the cotton batt 40. Exhaust hot air inlet 30 may also be used to preheat the ductwork leading from the mixing valve to the inlet 32 to the battery condenser 50. Additionally, exhaust from fan 14 may be used to not only preheat, but to continue to heat the bottom of the lint slide 34, which must be heated to cause the moisturized batt to flow smoothly down the lint slide. Fan 14 in my system is also used to provide a continuous loop of circulating hot air as the exhaust from the lint slide is carried back to the fan inlet 35.

With the moisturizing system used in the battery condenser 50, the condenser doffing system must also be heated and controlled hot air from the fan (14) exhaust is diverted at 36, along with the lint slide heating air to blow hot, dry air against the condenser cotton fiber contacting components under the influence of the battery condenser exhaust fan 27. With all the afore mentioned uses of the hot air exhaust, there will still be surplus exhaust hot air and valve 37 is used to exhaust this excess air to the exterior atmosphere.

Referring to FIG. 3 it may be seen that duct 43 can be used in conjunction with fan 81 to supply heated moist air to the stream of seed cotton entering feeder 86 to gin 87. Duct 43 may be a part of a completely separate system as shown in FIG. 3 or it may be split off a control system along with ducts from 35 and 36 as shown on FIG. 1. The hot moist air would pass through a perforated screen 83 to mix with the cotton prior to ginning. Warm dry air may be diverted from inlet 36 to maintain the temperature inside a heat jacket 84 about the inlet flue.

This concludes a general description of a preferred embodiment of my invention.

I will now describe more in detail the principles and functions of the components of my process and apparatus embodied as a fiber moisturizing system. As stated earlier, the degree of moisture addition is controlled by the temperature gradient between the cotton and humid air mixture and the relative humidity of the vapor mixture. The steam rising from the generator at ambient pressure will initially be at approximately 212 F. The cotton entering the battery condenser will be at temperatures well below this and thus, susceptible to condensation of a portion of the entrained vapor thereon. The temperature of the cotton fibers is normally largely controlled by the ambient temperature in the cotton gin plant. These temperatures can vary widely and, therefore, the moisturizing vapor mixture must be varied to maintain a uniform moisture addition. The moisture content of the lint in the bale following the moisture addition system can be measured either manually with handheld meters, or with one of several continuous automated systems now coming on the market which would include a sensor 61 intermediate the condenser and the baler iteratively or continuously sampling and reporting the moisture content of the batt to an electronic processing unit or logic circuit 63 providing the input signals the input signals used to signal the system to increase or decrease the moisture addition. Several physical properties can be used to measure moisture content. Meters based on electrical resistance, electrical capacitance, near-infrared light absorption, and radio-frequency absorption are available. Of the basic principles listed, the electrical resistance and near-infrared light absorption respond most significantly to changes in moisture content in lint. Logic circuits and programmable logic circuits, pc's and dedicated processors are commonly used in the cotton processing industry and the selection of a particular control unit is a matter of choice. Assuming a desired moisture level, say 7%, and a periodic signal indicating the actual moisture content, along with ambient temperature readings in the cotton gin plant reported by sensors 65 selectively placed in the plant, algorithms can be used to control the heater 13 output, which directly controls the amount of water vapor generated and secondarily affects the hot air exhaust temperature. It should be understood that modulation of the heater 13 does not appreciably change the temperature of the water vapor generated, as the water surface remains substantially at ambient pressure and the temperature of the vapor emitted from the surface is substantially at 212° Fahrenheit. The modulation of the burner does vary the amount of water vapor emitted. This concept is critical to the understanding of the functions of mixing valve 28. Let us assume for illustrative purposes that valves 29 and 30 are completely closed, the water in the tank is initially at room temperature, and the heater 13 is then ignited. There initially will be no fluid flow to the condenser inlet at 32 As the water in the tank is heated, moisture vapors will begin to rise from the surface of the water and flow up through vapor duct 26 through mixing valve 28 and condensate suppressor 31 on to condenser inlet 32. These passages, being at room temperature, would cause condensation all the way to the battery condenser which, of course, would be unsatisfactory. During this warm-up stage, the most heat available, while the water in the tank is being heated, should be applied to warm the interior surfaces of these vapor flow passages. Therefore, valve 29 should remain closed while valve 30 of-mixing valve 28 should-be-widely opened concurrently with generous hot exhaust air flow at valve 36 to pre-heat the ductwork to the battery condenser, the fiber contact surfaces of the battery condenser, and the lint slide 34. To maximize these flows, the exhaust valve at 37 may be at least partially closed. Note that the water vapor riser duct 26 would not be heated by this exhaust hot air and, therefore, it is designed to cause the water vapor to rise vertically out of the water tank area so the condensate from the vapor not entrained in the airflow and condensed on the side of duct 26 will run back down into the tank. Temperature sensors 67 at critical positions throughout these ducts may be used to modulate the valves just described to maintain the temperatures of the various components at levels to prevent condensation. These sensors, along with a water temperature sensor 69, will indicate when the system is ready to be put into full operation. As the temperature from mixing valve 28 to condenser inlet 32 approaches the desired level to prevent condensation, valve 30 can be modulated toward closed position and valve 29 may be opened incrementally to maintain the proper temperature from mixing valve 28 to battery condenser inlet 32. At this point, the water temperature at the surface, where the hot air enters, should be at just below the boiling point, with some water vapor rising from the surface of the water. The system is now ready to go into full operation. Initially, as the water approaches the boiling temperature at the end of the warm-up period, the output of air heater 13 drops back to low flame, then is gradually increased, thus increasing the amount of water vapor rising through duct 26 and replacing some of the hot air and ambient air being drawn in at valves 29 and/or 30 under the influence of fan 27. This action illustrates the heart of the quick response and sensitive control of the degree of moisture addition of my system by merely modulating the air heater output to change the rate of water vapor generation. The percentage of water vapor in the air-water vapor mixture can theoretically be raised from zero to 100% by varying only the air heater output. For every moisture addition requirement within the maximum capacity of a given system, my system can produce an optimum air-water vapor mixture by varying the air heater output. The heater 13 must have peak output limited to prevent the water vapor generation from completely replacing the air inlets at 29 and 30, or even blowing water vapor back through these valves. If air inputs through valves 29 and 30, were completely closed off, the water vapor only would soon result in condensation in the ductwork prior to arriving at condenser inlet 32 which, of course, would be unsatisfactory, as was previously mentioned. Therefore, valves 29 and 30 of mixing valve 28 may be restricted to prevent them from closing below minimum air intake positions. Fiber output moisture sensors 63 may be used to modulate the output of the air heater 13. Alternatively, empirically determined settings of the valves and heater output may be used to produce satisfactory moisture addition under many conditions.

Another factor that should be mentioned influencing the operation of the system is the partial vacuum produced by the condenser dust flue fan 27. Although the pressure in the moisture vapor conduit is maintained at or below ambient atmospheric pressure, increasing the vacuum produced by fan 27 will influence the ambient air intake at valve 29 and increase the vapor flow through the ducts to condenser inlet 32, which could allow heater 13 to boil more water to match the increased air flow, thus to increase the moisture addition capacity of the entire system. Another option that may be used with my system is to employ a separate small burner to supply the heated air to hot air inlet 30 of mixing valve 28. In this way, the variable temperature and pressure of the exhaust hot air from fan 14 would be eliminated at valve 28, thus making the moist air mixture supplied to the battery condenser at inlet 42 precisely controlled only by varying the output of the heater 13. With this option, the hot air exhaust from fan 14, though somewhat variable, could still be used to supply hot, dry air to heat the lint slide 34 and the battery condenser doffing system, which do not require precise temperature control.

In light of the foregoing, it can be seen that my in-transit fiber moisture addition system provides a highly effective, efficient, and controllable system that can optimize the moisture addition to cotton fibers during the ginning process to enhance the cotton fiber quality and market value and to increase the capacity and reduce the energy consumed at the baling press.

It is to be understood that the form of the invention shown is a preferred embodiment thereof and that various changes and modifications may be made therein without departing from the spirit of the invention or scope as defined in the following claims.

The invention claimed is:

1. In a cotton processing system wherein seed cotton and cotton fiber are conveyed, the improvement comprising apparatus for adding controlled amounts of moisture to said processing system at selected stages thereof, comprising in combination:

a. a combustion chamber having an ambient air inlet and a hot air outlet;

b. a water vapor generator in hot air communication with said combustion chamber and including a water tank, a plurality of ducts leading from said hot air outlet through said tank and outwardly there from, a water supply having a controllable inlet to said tank, and a vapor outlet leading from said tank;

c. a first fan connected to said plurality of ducts for drawing heated air there through and a hot dry air outlet; and, d. a mixing valve connected to an ambient air inlet and/or said hot dry air outlet and vapor outlet for combining a selectable portion of said ambient or hot dry air and water vapor from said water vapor generator, having a hot moist air outlet connected to said selected stages for delivery of water vapor thereto.

2. The improvement as defined in claim 1 wherein said selected stage comprises a gin stand and said connection to said gin stand is provided to supply hot moist air to seed cotton entering said gin stand for the removal of fiber from said seed cotton.

3. The improvement as defined in claim 1 wherein said selected stage is a battery condenser and further comprising a valve connected to said hot moist air outlet and adjustable to send a portion of said heated air to said condenser to supply moisture to cotton fiber forming a batt thereon.

4. Apparatus for use in seed cotton processing systems for increasing the moisture content of cotton fibers by exposing them to elevated temperature and elevated humidity air comprising: a heater for adding heat to ambient air; a heat transfer interface in contact with said heated air and separating said heated air from a water supply held within a chamber encompassing said heated air and said water supply, while transferring heat to said water supply sufficient to create water vapor from a portion of said water supply; at least one fan in fluid communication with said chamber; a variable valve in fluid communication with said fan and said chamber containing said water supply to selectively add ambient air and/or heated air to produce a vapor mixture of a desired temperature and relative humidity such that moisture in said vapor mixture will be adsorbed on cooler cotton fiber surfaces when said cotton fibers are exposed to said vapor mixture for subsequent absorption of said adsorbed moisture by the hygroscopic cotton fibers.

5. Apparatus as in claim 4 including at least one sensor operatively positioned to sense the moisture content of cotton fiber after absorption of said moisture and providing an electronic indication of said moisture content to a controller operatively connected to said heater to vary the amount of said heat added to said ambient air to result in said vapor mixture of a temperature and relative humidity to cause moisture to be adsorbed on cooler cotton fiber surfaces when said cotton surfaces are exposed to said vapor mixture.

6. Apparatus as in claim 5 wherein said variable valve comprises a housing receiving said water vapor through an opening in the housing, a second opening in the housing receiving a controlled air stream from ambient air external of the housing, a third opening receiving a controlled heated air stream, and an opening in the housing for discharging said vapor mixture to a conduit leading to said cotton fibers, wherein said controller defines the quantity of air received from said ambient air and said heated air.

7. Apparatus as in claim 5 wherein said variable valve comprises a housing receiving said water vapor through an opening in the housing, a second opening in the housing receiving a controlled air stream from ambient air external of the housing and an opening in the housing for discharging said vapor mixture to a conduit leading to said cotton fibers, wherein said controller defines the quantity of air received from said ambient air.

8. Apparatus as in claim 6 wherein said second opening has a valve associated therewith to selectively block ingress of said ambient air and wherein said third opening has a valve associated there with to selectively meter heated air and which can be opened to increase the heat energy applied to reduce the time to pre-heat the vapor mixture conduit to the cotton surfaces.

9. Apparatus as in 8 further comprising an independent air heater operably connected to said third opening.

10. Apparatus as in claim 5 further comprising temperature, moisture, pressure, and/or processing rate sensors operatively connected to said controller to provide data inputs thereto, said controller being programmed to selectively modulate said valve and said heater to maintain an optimum moisture content in said cotton fiber.

11. Apparatus as in claim 4 in which said vapor and/or said vapor mixture is maintained at or below ambient atmospheric pressure.

12. Apparatus as in claim 4 further comprising a valve for selectively directing partially spent heated air to heat surfaces in a cotton flow system to prevent moisture condensation on said surfaces.

13. Apparatus as in claim 4 further comprising a wall dividing said chamber, said wall extending to a distance below the surface of the water contained in said chamber, said heat transfer interface including a plurality of conduits connecting said heater and said valve said conduits passing through said chamber beneath said wall, said fan communicating with a portion of said chamber proximal said heater, and a controllable water inlet located in said chamber distal said heater and separated there from by said wall such that water moves in a first direction relative to said conduits and heated air moves in the opposite direction within said conduits.

14. Apparatus as in claim 4 in which said fan is downstream of a porous wall through which said cotton cannot pass, but through which the partially spent vapor mixture passes after depositing moisture condensate on the cooler cotton fiber surfaces.

15. Apparatus as described in claim 4 further comprising a downstream fluid pump operably connected to cause ambient air to flow through a heater and subsequently contact said heat transfer interface.

16. Apparatus as in claim 15 in which said downstream fluid pump is operably connected to said variable valve through which the partially heat depleted air is metered into said water vapor leaving said chamber.

17. Apparatus as in claim 15 in which said downstream fluid pump is operably connected to selectively direct a portion of said partially heat depleted air to heat surfaces with which said cotton comes in contact to prevent moisture condensation thereon.

18. Apparatus as in claim 17 in which a said surface with which said cotton comes in contact is heated by an enclosed chamber in fluid communication with said fluid pump, said chamber having an outlet opening connected to the inlet of said fluid pump to return the partially spent fluid to said fluid pump.

19. Apparatus as in claims 4 in which said heat transfer interface is made up of a plurality of tubes with rectangular cross-sections housed in a shell with a rectangular cross-section transverse to the fluid flows whereby the heat transfer surface is maximized and the volume of water in transit in the heat transfer is minimized.

20. Apparatus as in claim 19 in which said tubes surround said heated air and direct the air through a "U"-shaped path with the heated air entering the tubes at the upper end of the tubes at one side and the partially spent heated air leaving the tubes at the upper end of the "U" on the other side, said tubes are immersed in water to a controlled level near the tops of the tube ends and a wall is located between the vertical legs of the "U", said wall terminating near the bottom of the "U", thus to cause the water to flow counter to the heated air when the water supply is introduced near the top of the "U" on the side opposite the heated air entry.

21. Apparatus as in claim 20 which further includes a water vapor conveying housing rising vertically from the water surface in said surrounding shell at said heated air entry, said water vapor conveying housing leads to water condensate eliminator, a first lateral opening in the housing receiving a controlled air stream from ambient air external of the housing, a second lateral opening in said housing receiving a controlled heated air stream, thus to allow water droplets and condensate to flow by gravity back into said surrounding shell from said water vapor conveying housing and said condensate eliminator.

22. Apparatus as in claim 19 in which said tubes and said wall form an assembly that may be easily removed from said shell, thus to expose said tubes for removal of unwanted matter on the surfaces of the tubes.

23. The method of increasing the moisture content of seed cotton or raw cotton fibers by first heating water to produce a controlled amount of steam at atmospheric pressure and containing the steam within a housing into which controlled amounts of ambient and/or heated air are introduced to produce a vapor mixture of a temperature and water vapor content that will cause the mixture to reach its dew point when exposed to a stream of seed cotton or cotton fibers at a temperature below that of said vapor mixture, thus to cause water condensate to deposit on the surfaces of the cotton fibers to produce a predetermined moisture content in the cotton fibers, a vapor conduit means leading from said housing to and through said stream of seed cotton or cotton fibers under the influence of means to reduce the pressure at the exit of said conduit.

24. A system for increasing the moisture of seed cotton or lint fibers in a cotton gin plant or the like which includes an air heater to heat a supply of water flowing counter to the heated air in a heat exchange vessel, thus to produce a controlled amount of water vapor at ambient pressure, said vessel having an outlet for water vapor leading to a vapor mixing housing with inlets for controlled amounts of ambient and/or heated air to produce vapor mixtures with relative humidities and temperatures controlled to cause the dew points of the vapor mixtures to be reached when the vapor mixture is conveyed through duct work from said mixing housing to a condenser or seed cotton hopper where the vapor is exposed to the cotton which is at temperatures below that of the vapor mixture, thus to cause the dew point of the vapor mixture to be reached, and a predetermined amount of moisture is deposited on the surfaces of the cotton fibers, the movement of the fluids in the system being caused by fluid pumps.

* * * * *